US006444031B1

(12) United States Patent
Nas

(10) Patent No.: US 6,444,031 B1
(45) Date of Patent: Sep. 3, 2002

(54) APPARATUS FOR COATING PHOTORECEPTOR DEVICES

(75) Inventor: Geert Nas, Venray (NL)

(73) Assignee: Xerox Corporation, Stamford, CT (US)

( * ) Notice: Subject to any disclaimer, the term of this patent is extended or adjusted under 35 U.S.C. 154(b) by 111 days.

(21) Appl. No.: 09/627,034

(22) Filed: Jul. 27, 2000

Related U.S. Application Data

(62) Division of application No. 09/389,610, filed on Sep. 3, 1999, now abandoned.

(51) Int. Cl.[7] ..... B05C 3/00
(52) U.S. Cl. ..... 118/429; 118/412
(58) Field of Search ..... 118/412, 429; 427/430.1, 58; 137/8

(56) References Cited

U.S. PATENT DOCUMENTS 4,828,779 A 5/1989 Hiraki et al. ..... 264/171
5,501,737 A 3/1996 Takahashi et al. ..... 118/410
5,681,391 A 10/1997 Mistrater et al. ..... 118/400
5,725,667 A 3/1998 Petropoulos et al. ..... 118/407

*Primary Examiner*—Brenda A. Lamb
(74) *Attorney, Agent, or Firm*—Wayne J. Egan

(57) ABSTRACT

An apparatus for coating photoreceptor devices comprises a manifold forming a conduit, the conduit having a length with an input at one end. Multiple diptanks for applying photoreceptor coating solution to devices dipped therein are mounted on an upper portion of the manifold and distributed along the length. The conduit is arranged so that photoreceptor coating solution supplied to the input flows to the diptanks, thus forming a photoreceptor coating solution flow in each diptank. The conduit becomes increasingly narrower as the photoreceptor coating solution flows along the length successively from one diptank to the next diptank. As a result, the photoreceptor coating solution flow speed in each diptank is substantially the same.

12 Claims, 2 Drawing Sheets

APPARATUS FOR COATING PHOTORECEPTOR DEVICES

This application is a divisional of application Ser. No. 09/389,610, filed Sep. 3, 1999 now abandoned.

FIELD OF THE DISCLOSURE

This disclosure relates generally to photoreceptor devices and, in particular, to an apparatus and method for coating photoreceptor devices.

BACKGROUND OF THE INVENTION

It is known to use diptanks to apply photoreceptor coating solution to photoreceptor devices. It is further known to use a manifold to supply the photoreceptor solution to the diptanks so the photoreceptor devices, which are cylindrical-shaped, may be coated therein.

Typically, a manifold is arranged to supply photoreceptor coating solution to multiple diptanks. As a result of the manifold, photoreceptor coating solution is caused to flow in each diptank of the multiple diptanks. Photoreceptor devices are then dipped into the diptanks.

Once inserted in the diptanks, the devices will be removed from the diptank with a controlled speed, and a thin layer of photoreceptor coating solution becomes coated upon each device.

During this coating process, it is very important that the overflow of the photoreceptor coating solution in every diptank be uniform and the same amount.

To increase process yield, the manifold is equipped with many diptanks, thus allowing a like number of devices to be coated at the same time. With a large number of devices being coated simultaneously, the problem is how to obtain uniform coating results with respect to charge generator layer coating thickness and other electrical specifications for all devices in the same batch. In other words, the goal is to simultaneously coat multiple photoreceptor devices, wherein each device is coated identically to each other device in the same batch.

One key to obtaining identical coating results for all devices in the same coating batch is to maintain identical flows and overflow of photoreceptor coating solution in each diptank during the coating process.

With existing photoreceptor coating arrangements, the multiple diptanks are supplied by manifolds with a uniform diameter along the flow direction. As a result of multiple diptanks being supplied by constant-diameter manifolds, the coating solution flow speeds varies substantially from diptank to diptank. As a result of varying coating solution flow speeds, the coating process likewise varies substantially from diptank to diptank.

With this existing constant-diameter manifold approach, for diptanks located substantially "upstream" or "downstream" along the manifold flow direction from each other, the coating results are especially non-uniform. This is because the manifold's coating solution flow speed varies along the manifold's length as it supplies the multiple diptanks spaced along the length. Moreover, this constant-diameter manifold approach results in multiple devices being coated with their individual coating layers being substantially different.

Another problem with this existing constant-diameter manifold approach is that the diptank needs to be placed out of level to maintain an equal overflow on all the diptanks, even though this will result in other defects and unequal non-coated areas on the devices.

It is thus desirable to provide an apparatus and method for coating photoreceptor devices in multiple diptanks that will provide for the photoreceptor coating solution flow speed in each diptank of the multiple diptanks to be the same.

Therefore, there is a need for an improved apparatus and method for coating photoreceptor devices.

SUMMARY OF THE INVENTION

In one aspect of the invention, there is provided an apparatus for coating devices. The apparatus comprises a manifold forming a conduit, the conduit having a length with an input at one end thereof. The apparatus further comprises a plurality of diptanks mounted on an upper portion of the manifold and distributed along the length. The plurality of diptanks are arranged for applying coating solution to devices that are dipped therein. The conduit is arranged so that coating solution supplied to the input flows to the plurality of diptanks, thus forming therein a plurality of diptank coating solution flows. The conduit becomes increasingly narrower as the coating solution flows along the length successively from one diptank to the next diptank of the plurality of diptanks. As a result, the plurality of flow speeds of the corresponding plurality of diptank coating solution flows are substantially uniform.

In another aspect of the invention, there is provided an apparatus for coating devices. The apparatus comprises a manifold forming a conduit, the conduit having a length with an input at one end thereof. The apparatus further comprises a plurality of diptanks mounted on an upper portion of the manifold and distributed along the length, the plurality of diptanks being arranged for applying coating solution to devices dipped therein. The conduit is arranged so that coating solution supplied to the input flows to the plurality of diptanks thus forming a diptank coating solution flow with a corresponding diptank coating solution flow speed in each of the plurality of diptanks. The conduit is wedge-shaped along the length, thereby causing each of the plurality of diptank coating solution flow speeds to be substantially equal with respect to each other.

In another aspect of the invention, there is provided a method for coating devices using an apparatus. The apparatus comprises a manifold forming a conduit, the conduit having a length with an input at one end thereof. The apparatus further comprises a plurality of diptanks mounted on an upper portion of the manifold and distributed along the length. The plurality of diptanks are arranged for applying coating solution to devices that are dipped therein. The conduit is arranged so that coating solution supplied to the input flows to the plurality of diptanks, thus forming therein a plurality of diptank coating solution flows. The conduit becomes increasingly narrower as the coating solution flows along the length successively from one diptank to the next diptank of the plurality of diptanks. As a result, the plurality of flow speeds of the corresponding plurality of diptank coating solution flows are substantially uniform. The method comprises the steps of: a supplying coating solution to the input, and b dipping devices into the plurality of diptanks, thereby applying coating solution to the devices.

DESCRIPTION OF THE PREFERRED EMBODIMENTS

Briefly, an apparatus for coating photoreceptor devices comprises a manifold forming a conduit, the conduit having a length with an input at one end. Multiple diptanks for applying photoreceptor coating solution to devices dipped therein are mounted on an upper portion of the manifold and distributed along the length. The conduit is arranged so that photoreceptor coating solution supplied to the input flows to the diptanks, thus forming a photoreceptor coating solution flow in each diptank. The conduit becomes increasingly narrower as the photoreceptor coating solution flows along the length successively from one diptank to the next diptank. As a result, the speed of the photoreceptor coating solution flow in each diptank is substantially the same.

Figure 1:
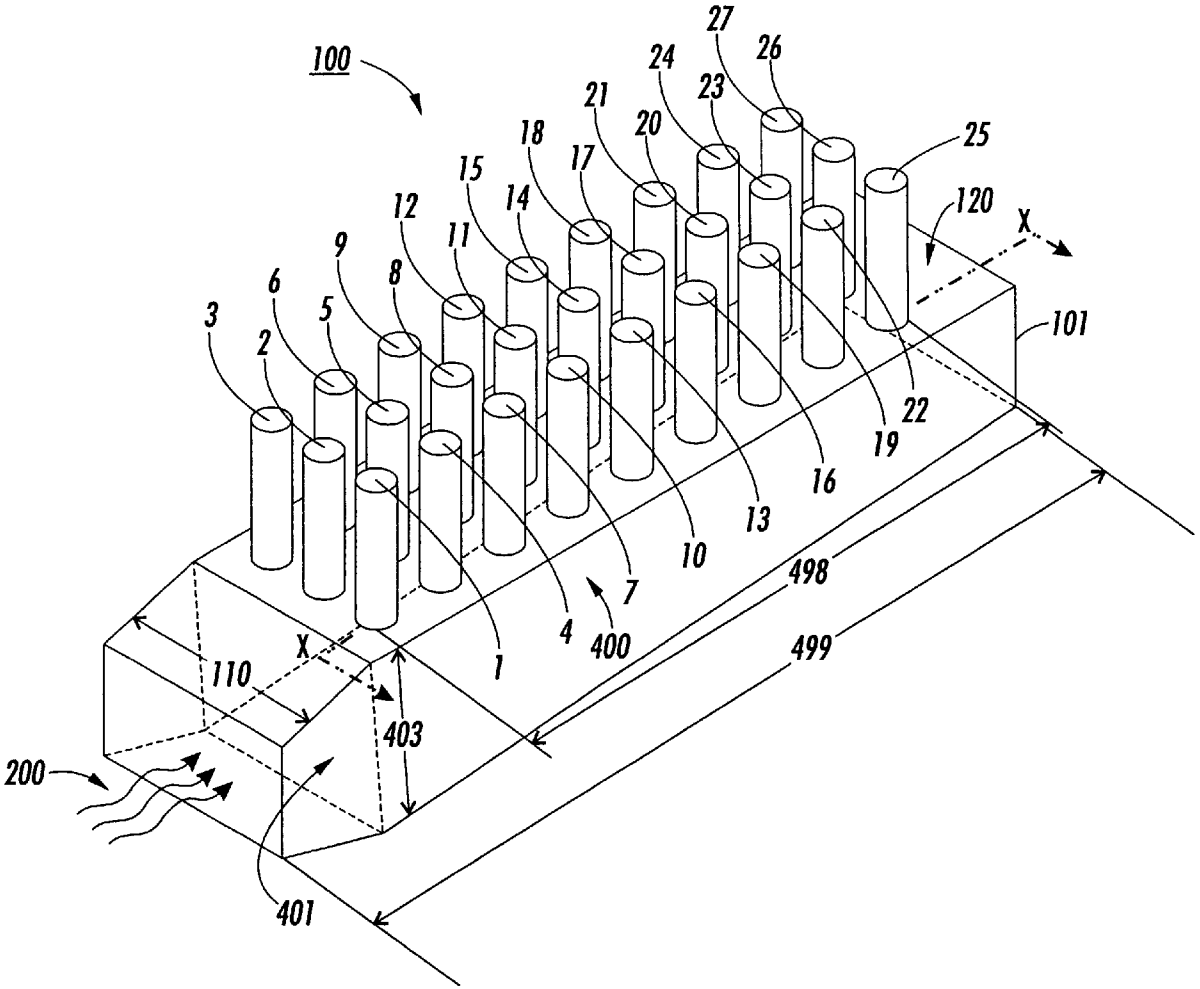
FIG. 1 is a perspective view of an apparatus for coating photoreceptor devices, in accordance with the present invention.

Referring now to FIG. 1, there is shown an apparatus 100 for coating devices. The apparatus comprises a manifold 101 forming a conduit 400, the conduit having a length 499 with an input 401 at one end thereof. The apparatus further comprises a plurality of 27 diptanks designated 1–27 mounted on an upper portion 120 of the manifold and distributed along a portion 498 of the length 499, the plurality of diptanks arranged for applying coating solution to devices that are dipped therein. The 27 diptanks are arranged in 9 columns of 3 diptanks each, the 9 columns spaced substantially uniformly along the length portion 498, with each column of 3 diptanks spaced substantially uniformly across the manifold width 110.

Figure 2:
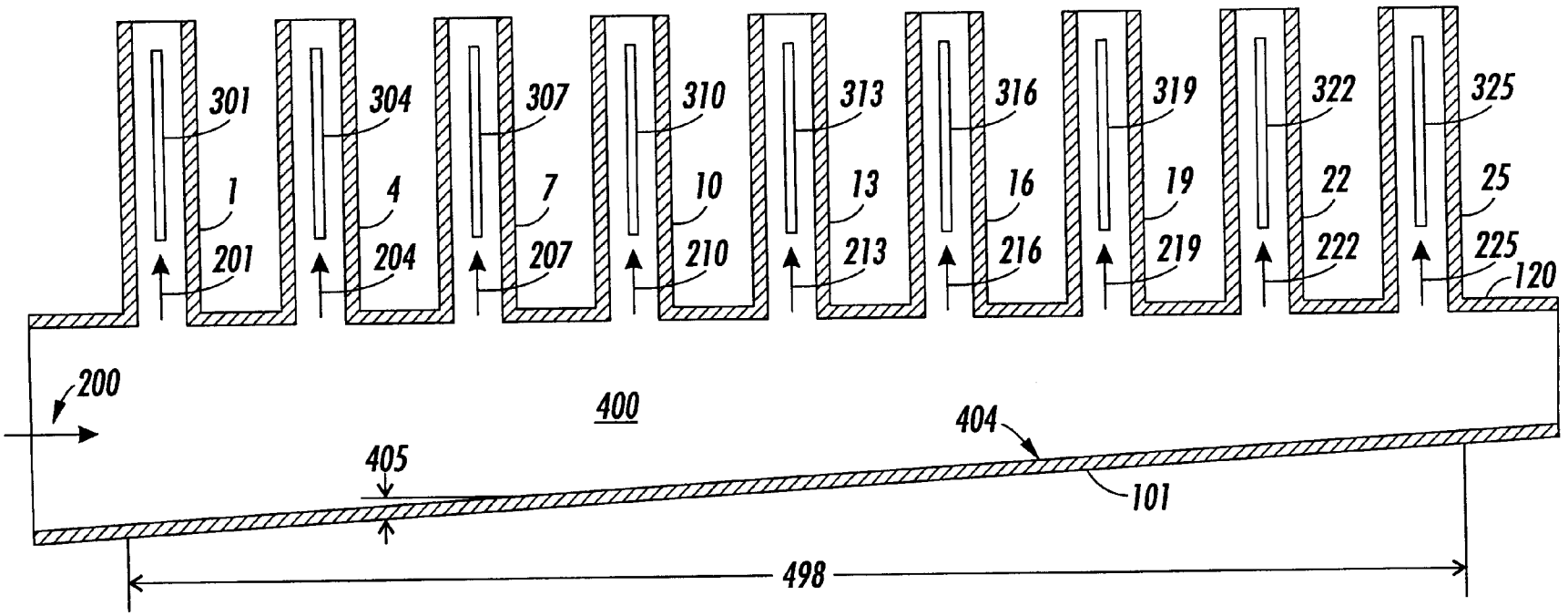
FIG. 2 is a cross-section view of the FIG. 1 apparatus along the line X.

FIG. 2 is a cross-section view of the FIG. 1 apparatus along the line X. There is shown the conduit 400 arranged so that coating solution 200 supplied to the input 401 flows to the plurality of diptanks 1, 4, 7,10,13,16,19, 22 and 25, thus forming therein a plurality of diptank coating solution flows 201, 204, 207, 210, 213, 216, 219, 222, and 225, thus coating devices 301, 304, 307, 310, 313, 316, 319, 322 and 325 which have been dipped therein.

While the drawing only shows only those 9 diptanks 1, 4, 7,10,13,16, 19, 22 and 25 that fall along the line X, it will be appreciated that in practice the coating solution 200 simultaneously supplies solution flow to all 27 diptanks 1–27, thereby generating 27 individual solution flows in all 27 diptanks 1–27, and thereby causing coating solution to be applied to 27 devices that are simultaneously dipped in the 27 diptanks 1–27.

Still referring to FIG. 2, it is seen the conduit 400 becomes increasingly narrower as the coating solution flows along the length portion 498 successively from one diptank to the next diptank of the plurality of diptanks. Moreover, the conduit includes a lower wall 404 that slopes upwards along the length 498 in the direction of flow 200 at a substantially fixed angle 405 with respect to the upper portion, the fixed angle being approximately 0.076 radians.

As a result of this upward slope by wall 404, the manifold 101 and conduit 400 manifest a "wedge" shape.

Moreover, based on the wedge shape of conduit 400, the plurality of flow speeds of the corresponding plurality of diptank coating solution flows are caused to be substantially uniform. In other words, conduit 400's shape results in the individual coating solution flow speed in each diptank 1–27 to be substantially the same.

The apparatus 100 may be used to coat devices with photoreceptor coating solution by a method comprising the following steps:

(a) supplying photoreceptor coating solution flow 200 to the conduit input 401, thereby establishing coating solution flows in the diptanks 1–27; and (b) dipping photoreceptor devices into the plurality of diptanks 1–27, thereby applying photoreceptor coating solution to the photoreceptor devices.

In one embodiment, this invention is used for coating organic photoreceptors having 30–40 mm diameters.

In practice, the size of the manifold should be large enough to allow for cleaning the equipment. On the other hand, if the manifold is too large the flow speed of the coating solution will be too low, thus causing the pigments in the coating solution to settle on the bottom of the manifold.

Some advantages of the present invention is that photoreceptor coating yield is improved. Also, the invention results in superior electrical uniformity for all devices coated in the same batch. Also, the invention results in less charge generator layer coating defects. Also, the invention results in less production downtime by simple adjustments of the diptanks.

While various embodiments of an apparatus and method for coating photoreceptor devices, in accordance with the present invention, have been described above, the scope of the invention is defined by the following claims.

I claim:

1. An apparatus for coating photoreceptor devices, the apparatus comprising a manifold forming a conduit, the conduit having a length with an input at one end thereof, the apparatus further comprising a plurality of diptanks mounted on an upper portion of the manifold and distributed along the length, the plurality of diptanks arranged for applying coating solution to photoreceptor devices that are dipped therein, the conduit arranged so that the coating solution supplied to the input flows away from the input in a flow direction towards the plurality of diptanks thus forming therein a corresponding plurality of diptank coating solution flows, each diptank coating solution flow comprising a corresponding diptank coating solution flow speed, the conduit defining a conduit inner diameter that becomes increasingly narrower along the length in the flow direction such that the plurality of diptank coating solution flow speeds are substantially uniform.

2. The apparatus of claim 1, the plurality of diptanks comprising 27 diptanks.

3. The apparatus of claim 2, the 27 diptanks arranged in 9 columns of 3 diptanks each, the 9 columns spaced substantially uniformly along the length.

4. The apparatus of claim 3, the conduit having a lower wall that slopes along the length at a substantially fixed angle with respect to the upper portion.

5. The apparatus of claim 4, the fixed angle being about 0.076 radians.

6. The apparatus of claim 1, the coating solution comprising photoreceptor coating solution.

7. An apparatus for coating photoreceptor devices, the apparatus comprising a manifold forming a conduit, the conduit having a length with an input at one end thereof, the apparatus further comprising a plurality of diptanks mounted on an upper portion of the manifold and distributed along the length, the plurality of diptanks arranged for applying coating solution to photoreceptor devices dipped therein, the conduit arranged so that the coating solution supplied to the input flows away from the input in a flow direction towards the plurality of diptanks thus forming a diptank coating solution flow with a corresponding diptank coating solution flow speed in each of the plurality of diptanks, the conduit being wedge-shaped thus defining a wedge-shaped conduit inner diameter that becomes increasingly narrower along the length in the flow direction, thereby causing each of the plurality of diptank coating solution flow speeds to be substantially equal with respect to each other.

8. The apparatus of claim 7, the plurality of diptanks comprising 27 diptanks.

9. The apparatus of claim 8, the 27 diptanks arranged in 9 columns of 3 diptanks each, the 9 columns spaced substantially uniformly along the length.

10. The apparatus of claim 7, the conduit having a lower wall that slopes along the length at a substantially fixed angle with respect to the upper portion.

11. The apparatus of claim 10, the fixed angle being about 0.076 radians.

12. The apparatus of claim 7, the coating solution comprising photoreceptor coating solution.

* * * * *